US006055497A

United States Patent [19]

Hallkvist et al.

[11] Patent Number: 6,055,497

[45] Date of Patent: Apr. 25, 2000

[54] SYSTEM, ARRANGEMENT, AND METHOD FOR REPLACING CORRUPTED SPEECH FRAMES AND A TELECOMMUNICATIONS SYSTEM COMPRISING SUCH ARRANGEMENT

[75] Inventors: Per Hallkvist, Älvsjö; Peter Galyas; Stefan Jung, both of Täby; Johan Andersson, Lidingö, all of Sweden

[73] Assignee: Telefonaktiebolaget LM Ericsson, Stockholm, Sweden

[21] Appl. No.: 08/924,878

[22] Filed: Sep. 5, 1997

Related U.S. Application Data

[63] Continuation of application No. PCT/SE96/00311, Mar. 11, 1996.

[30] Foreign Application Priority Data

Mar. 10, 1995 [SE] Sweden ..... 9500858

[51] Int. Cl.[7] ..... G10L 21/02

[52] U.S. Cl. ..... 704/228; 714/747

[58] Field of Search ..... 704/226, 227, 704/228, 225, 233, 278, 200, 201; 371/31, 36, 37.02; 714/747

[56] References Cited

U.S. PATENT DOCUMENTS

| | | | |
|---|---|---|---|
| 4,593,392 | 6/1986 | Kouyama | 714/747 |
| 4,829,523 | 5/1989 | Bretl | 714/747 |
| 5,142,582 | 8/1992 | Asakawa et al. | 704/228 |
| 5,309,443 | 5/1994 | Schorman | 371/5.5 |
| 5,485,522 | 1/1996 | Solve et al. | 381/56 |
| 5,491,719 | 2/1996 | Sellin et al. | 375/213 |
| 5,572,622 | 11/1996 | Wigren et al. | 704/228 |
| 5,699,485 | 12/1997 | Shoham | 704/223 |
| 5,815,533 | 9/1998 | Mourot | 375/316 |

FOREIGN PATENT DOCUMENTS

| | | | |
|---|---|---|---|
| 544 101 | 6/1993 | European Pat. Off. | H04B 1/46 |
| 599 664 | 6/1994 | European Pat. Off. | G10L 9/18 |
| 2 256 351 | 12/1992 | United Kingdom | H04B 3/20 |

OTHER PUBLICATIONS

GSM Recommendations 6.10, "GSM Full–Rate Speech Transcoding," European Telecommunications Standard Institute, France, 1990 (revised Sep. 1994).

GSM Recommendations 6.11, "GSM Substitution and Muting of Los Frames for Full Rate Speech Channels, " European Telecommunications Standard Institute, France, Sep. 1994.

GSM Recommendations 6.12, "GSM Comfort Noise Aspect for Full Rate Speech Traffic Channels, " European Telecommunications Standard Institute, France, Sep. 1994.

GSM Recommendations 6.31, "GSM Discontinuous Transmission (DTX) for Full Rate Speech Traffic Channel," European Telecommunications Standard Institute, France, Sep. 1994.

GSM Recommendations 6.32, "GSM Voice Activity Detection (VAD), "European Telecommunications Standard Institute, France, Oct. 1996.

*Primary Examiner*—David R. Hudspeth
*Assistant Examiner*—Donald L. Storm
*Attorney, Agent, or Firm*—Burns, Doane, Swecker & Mathis, L.L.P.

[57] ABSTRACT

A system and method are provided for improving speech quality for signals divided into a frame structure. Speech information in a signal is detected, and a lost or corrupted transmitted frame is detected. The lost or corrupted frame is replaced by a suitable frame if a number of frames represented e.g., by a counter value, exceeds a predetermined value. The counter value may be changed, depending on whether the system is in a comfort noise generation state or in a muting period. The frame may be replaced by a frame representing mainly background noise, generated at the transmitting end during speech pauses or at the receiving end, or such a frame and a correctly received frame. The predetermined value may be the length of a muting period or may be the number of lost or corrupted frames preceding a speech frame. A first of the correctly received speech frames that follows a number of lost or corrupted frames may also be replaced. The output frames gradually approach pure speech frames.

18 Claims, 8 Drawing Sheets

FIG.4

| CBF | OUTPUT |
|---|---|
| 0 | Not bad. Use received frame. |
| 1 | Repeat all parameters of last correctly received frame |
| 2 | * Repeat all LAR parameters and the LTP lag from last correctly received frame.<br>* Mute the LTP gain and Xmax parameters like: 75% from last correctly received speech frame + 25% from last correctly received SID frame.<br>* Use the other parameters from current received frame. |
| 3 | * Repeat all LAR parameters and the LTP lag from last correctly received frame.<br>* Mute the LTP gain and Xmax parameters like: 50% from last correctly received speech frame + 50% from last correctly received SID frame.<br>* Use the other parameters from current received frame. |
| 4 | * Repeat all LAR parameters and the LTP lag from last correctly received frame.<br>* Mute the LTP gain and Xmax parameters like: 25% from last correctly received speech frame + 75% from last correctly received SID frame.<br>* Use the other parameters from current received frame. |
| ⩾5 | Repeat last correctly received SID-frame. |

SYSTEM, ARRANGEMENT, AND METHOD FOR REPLACING CORRUPTED SPEECH FRAMES AND A TELECOMMUNICATIONS SYSTEM COMPRISING SUCH ARRANGEMENT

This application is a continuation of International Application No. PCT/SE96/00311, with an international filing date of Mar. 11, 1996, which designated the United States.

BACKGROUND

The present invention relates to an arrangement and a method relating to speech transmission wherein the transmitted signals are divided into a frame structure. The invention also relates to a telecommunications system comprising an arrangement relating to speech transmission.

In digital telecommunications systems a frame structure is almost always used and speech is transmitted in speech (traffic) frames. A frame here relates to an information block comprising a given number of digital information bits. When speech is to be transmitted the solution is not straightforward since on one hand both speech and background noise, which may vary to a great extent, is present and on the other hand a human speaker normally does not speak uninterruptedly but now and then makes pauses and remains silent. Furthermore, frames or speech-frames may be bad, i.e. lost or corrupted during transmisson.

When a transmitted frame is bad or lost it will generally be replaced since normal decoding of such frames would produce noise effects which are very annoying for a listener.

GSM Recommendations GSM 06.11, October 1992, "Substitution and Muting of Lost Frames for Full-Rate Speech Channels" relates to muting when the full-rate speech coding is applied, i.e. they define a frame substitution and muting procedure to be used by the receiving side when one or more lost speech frames or SID (Silence Descriptor) frames are received.

When speech frames have been lost, the speech volume is decreased. A muting technique is disclosed through which the output level is decreased gradually resulting in silencing of the output after a maximum 320 ms. This means that silence will be received after max 320 ms which can be very annoying since it is an abrupt change from speech plus background noise to silence. Often a period which is shorter than 320 ms is used in practice which can be even more annoying.

If aural information comprises both speech and background noise mixed, muting towards silence induces inconvenient sparkling. Thus, for a number of known muting algorithms which are applied on disturbed speech coding parameters, the background noise chops down to silence and this may happen more than once a second. Furthermore, known solutions do not take into account such situations when background noise is present such as babble, car-noises etc., which however are realistic traffic cases.

SUMMARY OF THE INVENTION

A problem in speech transmission is that the sound (aural) information may comprise speech or background noise or speech and background noise mixed. In the last case, and if muting towards silence, in the case of frames being lost or corrupted during transmission, inconvenient sparkling is induced. The reason for this is the alternation between complete silence and speech or noise.

It is an object of the present invention to provide an arrangement and a method respectively in a speech transmission system wherein discomforting effects because of speech frames being lost or corrupted during transmission are reduced to a minimum.

Particularly it is an object of the invention to provide an arrangement and a method respectively through which discomforting effects can be minimized or avoided when two or more consecutive speech frames are lost.

It is another object of the present invention to provide an arrangement and a method respectively which can be applied regardless of whether the transmission is discontinuous or continuous.

Generally it is an object of the invention to provide an arrangement and a method respectively which is flexible, which can be applied in different systems having different requirements as to power savings etc. and which is reliable, efficient and which can easily be applied.

It is also an object of the present invention to provide a telecommunications systems comprising an arrrangement in a speech transmission system which meets the abovementioned objects.

These as well as other objects are achieved through an arrangement and a method respectively wherein if a frame is lost or corrupted during transmission, it can be replaced by a frame representing mainly background noise. Alternatively it is replaced by a combination of at least one frame representing mainly background noise and at least one correctly received speech frame. If particularly two or more consecutive frames are corrupted or lost during transmission, they are replaced by frames which are combinations of background noise frames and speech frames in such a way as to gradually approach background noise.

At least one background noise frame must in some way be available on the receiving side. In a particular embodiment the DTX-function (described in GSM recommendations GSM 06.31 "Discontinuous Transmission (DTX) for full-rate Speech Traffic Channels") is applied and SID frames provided by the DTX function generated at the transmitting end are used.

In another embodiment SID frames are generated at the transmitting end and transmitted during periods of no speech although DTX is not used. In still another embodiment frames representing background noise (e.g. SID frames) are generated at the receiving side. In another alternative embodiment, a default SID frame is used on the receiving side, which is used when DTX is not activated or not used.

Generation of noise as such ca n be done in different ways and it is supposed to be known.

Also the bad frame indicating means can be any adequate bad frame indicating means.

In a particular embodiment of the invention is dealt with the problem when occasionally frames which are not bad are received in periods when bad frames dominate. A change from comfort noise to full volume speech frames may then be disturbing.

According to the invention may therefore, if a speech frame is correctly received and the at least two preceding speech frames were lost or corrupted during transmission, the correctly received speech frame be replaced by a frame which is a combination of the correctly received speech frame and at least one frame representing background noise. Particularly, if a given number of consecutive correctly received frames are preceded by a given number of bad frames, the correctly received frames are replaced by frames which are combinations of speech frames and background noise frames so as to gradually approach speech.

The invention thus proposes solutions in which ramping down is provided or ramping down and ramping up or just ramping up.

For the latter case an arrangement in a speech transmission wherein signals are divided into a frame structure is given, comprising means for detecting if a signal contains speech information and means for detecting if frames are bad or not. If a speech frame is correctly received, it is examined if a given number of frames directly preceding the received frame are bad, and if so, the correctly received speech frame is replaced by a frame representing a combination of background-noise and a correctly received speech frame.

Particularly, if a given number of consecutive non-bad frames are preceded by a given number of bad frames, the non-bad frames are replaced by frames which are combinations of speech frames and background noise frames so as to gradually approach speech.

Particular embodiments of the invention relate to the GSM system. For these embodiments the GSM recommendations as referred to in the application are applicable and define a number of functions etc.

When discussing a receiving and a transmitting side respectively, for example in a mobile communication system, it may relate to e.g. a radio base station both as a sender sending to a mobile station (a downlink connection) and to a radio base station as a receiving arrangement whereas a mobile station is the sending arrangement (an uplink connection).

It is an advantage of the invention that if frames are lost or corrupted during transmission, the effects thereof are reduced considerably as compared to hitherto known systems. The great flexibility in the applicability of the invention is also a great advantage and it can be used in generally every digital telecommunications system for speech transmission. The invention is mainly focused on digital, frame structure based, systems as referred to in the state of the art.

The invention can though be applied in analog system; this however requires additional installations as will be referred to in the detailed description of the invention.

BRIEF DESCRIPTION OF THE DRAWINGS

The invention will in the following be further described in a non-limiting way under reference to the accompanying drawings wherein:

FIG. 4 illustrates a table describing the muting procedure in detail.

DETAILED DESCRIPTION

The invention will first be further described in relation to the full rate speech coder of the GSM system although the invention by no means is limited to said system. In an alternative embodiment (not further described) half-rate speech transcoding on half-rate speech channels is applied. In the cellular mobile system GSM speech is transmitted in the form of speech frames comprising encoded speech data as referred to earlier in the application. The arrangement comprises means for detecting if voice activity is present or not, i.e. frames containing speech are distinguished from frames containing silence or just background noise. These voice activity detecting means are generally referred to as a voice activity detector VAD. The VAD algorithm is defined in the GSM Recommendations GSM 06.32, "Voice Activity Detection".

In the following a first embodiment will be discussed in relation to FIG. 1 relating to the GSM system operating in discontinuous transmission mode which is defined in the GSM Recommendations GSM 06.31 "Discontinuous Transmission (DTX) for Full-Rate Speech Traffic Channels". Discontinuous transmission DTX is a mechanism which allows a radio transmitter to be switched off most of the time when there is no speech, i.e. during speech pauses. Two reasons for doing so are to save power and to reduce the over-all interference level on the air. Then background noise is estimated by an algorithm, through averaging speech parameters in four consecutive speech frames, a voice activity detector (VAD) as referred to above determines whether an incoming signal contains speech information or not.

In periods when the VAD indicates no speech, a SID frame is sent with regular intervals. In the periods between these updates the transmitter can be turned off.

The GSM system discloses a full-rate speech coding algorithm which performs a compression of incoming speech samples reducing the bitrate with approximately 90%. The GSM full-rate speech coding is discussed in GSM Recommendations 06.10, January 1990, "GSM Full-Rate Speech Transcoding". However, using this generally makes the speech channel becoming less robust to induced bit errors.

Figure 1:
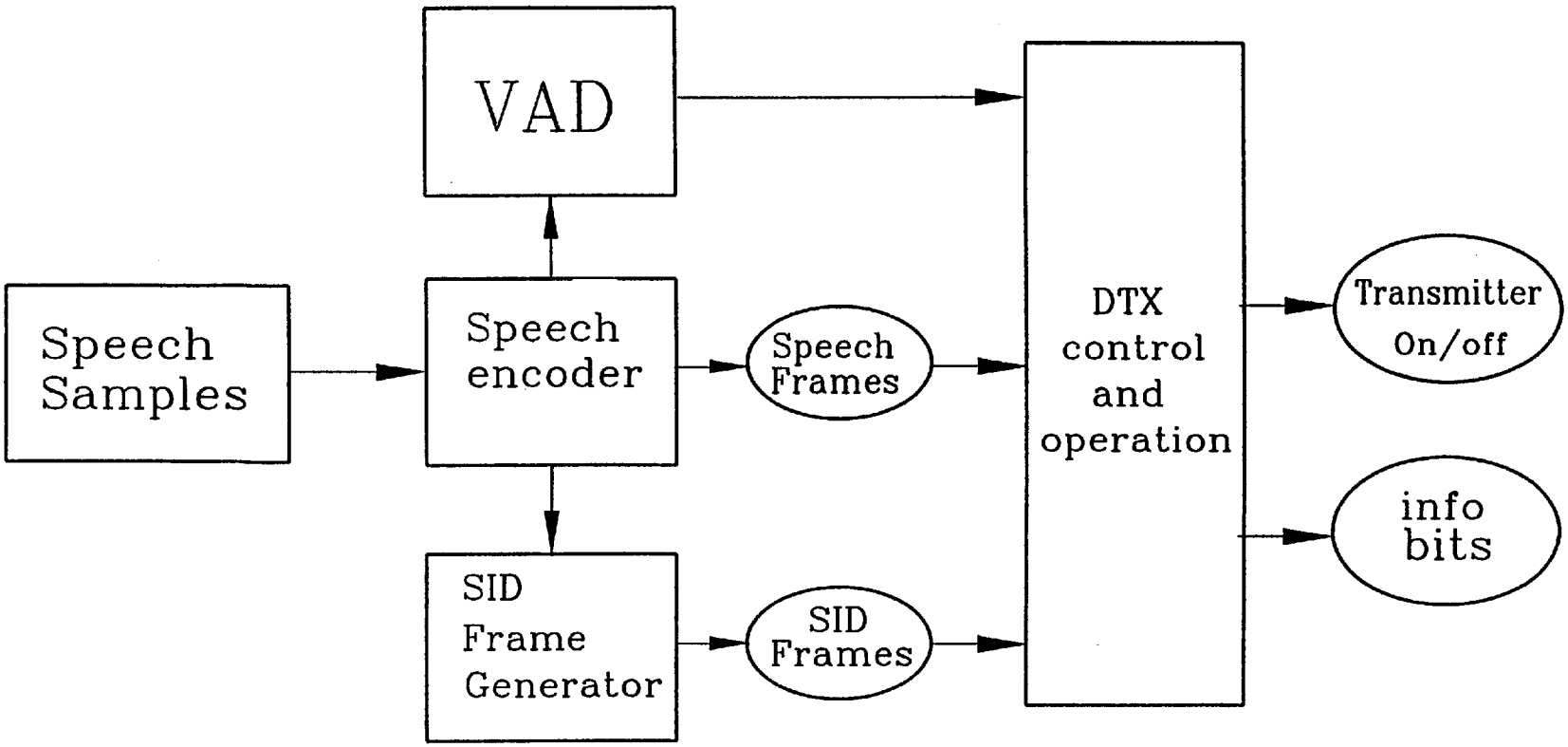
FIG. 1 is a block diagram illustrating the transmitting side in a first embodiment of the invention.

FIG. 1 shows the transmitting side. Incoming speech samples are speech encoded to reduce the bitrate. The output from the speech encoder is a given number of speech frames every second.

The voice activity detector has an output signal VAD-flag, that indicates if the present frame contains speech information or not.

When a number of consecutive frames containing no speech information has been detected, a SID frame generator calculates a SID frame based on the current frame and a given number of old frames. In periods of no speech activity, SID-frames can, on the receiver side, be used to generate background noise over a longer period of time than an ordinary speech frame.

Through the SID frame generator SFG the characteristics of the background noise are measured in case of no speech and a SID frame (containing parameters describing background noise) is produced.

The DTX control and operation has two output signals. Info bits are normally the speech frames from the speech encoder, and the "transmitter on" flag is set true.

In case of several speech frames marked with "no VAD", at least as many as required to produce a SID frame based on just "no VAD" marked frames, the info bits are set to be the SID frame.

In periods where the info bits are set to be SID-frames, the "transmitter on" flag is set to false, except for some regular updates.

Figure 2:
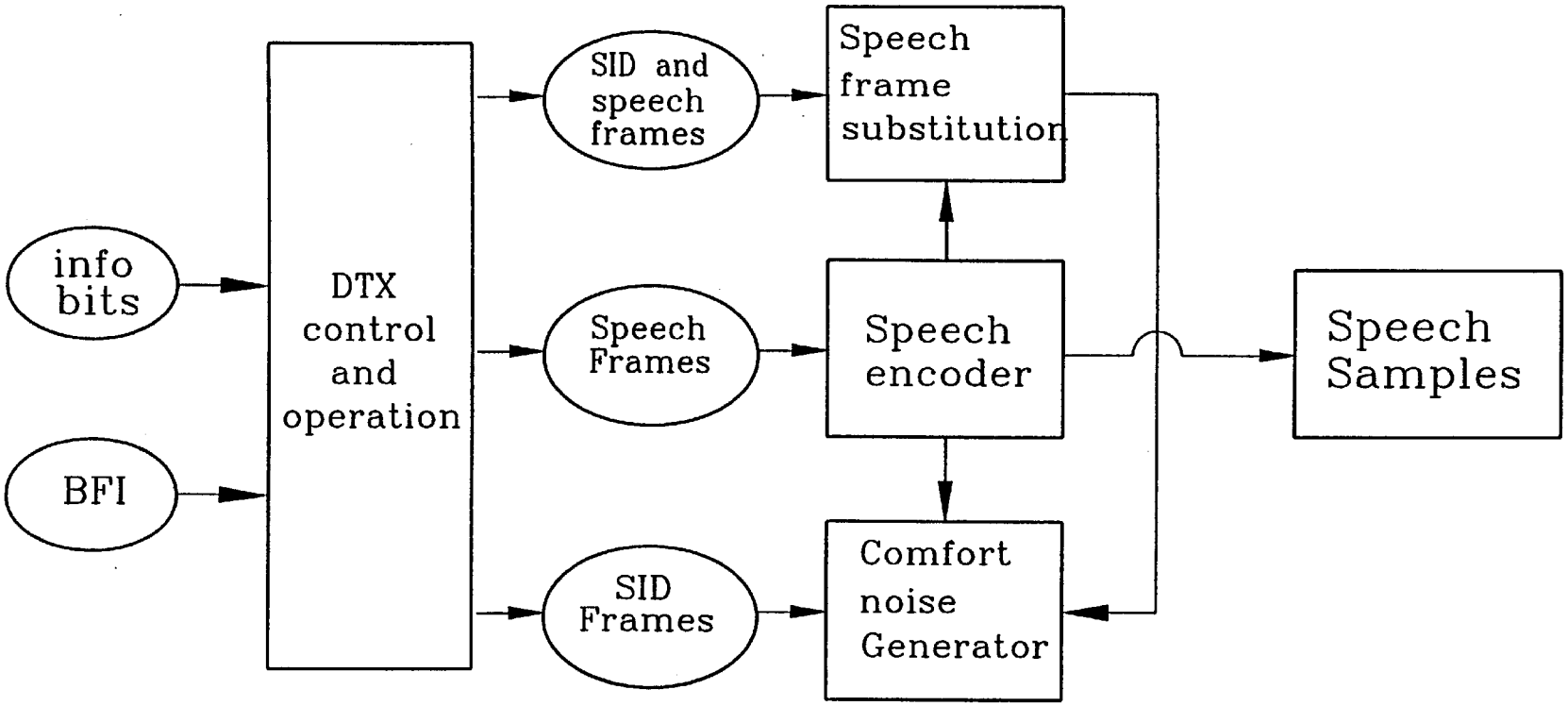
FIG. 2 is a block diagram of the receiving side corresponding to the embodiment of FIG. 1.

FIG. 2 shows the receiving side. The first input signal comprises the info bits, received from a non-perfect channel. The second is the BFI (Bad Frame Indication) flag from a channel decoding or equalizing device marking bad frames. A frame can be marked as bad for two reasons, namely that some info bits are suspected to be erroneous, or that no frame is received, possible because the transmitter has been turned off.

It should be noted however that the present invention only relates to frames bad in the sense that they are lost or corrupted during transmission. The invention is thus not concerned with deliberate transmission pauses due to DTX.

The DTX control and operation unit determines if the received info bits comprise a SID frame or a speech frame.

In case of a speech frame, it is speech decoded, producing speech samples. In case of a SID frame, the comfort noise generator generates a frame that describes background noise.

In case of a BFI marked frame, the speech frame substitution unit produces a speech frame which is sent to the speech decoder or a SID-frame which is sent to the Comfort Noise Generator. The produced frame is in this case based on (1) previously received speech frames, (2) a previously received SID-frame and (3) current received bad frame.

The basics of discontinuous transmission DTX will now be briefly discussed. The DTX function requires a VAD on the transmit side, evaluation of background noise on the transmit side for transmitting characteristic parameters to the receiving side and generation of comfort noise similar thereto on the receive side when radio transmission is cut.

This is further described in GSM Recommendations GSM 06.31. The DTX operation mode provides for having the transmitters switched on only as long as the frames comprise useful information. The DTX mechanism is implemented in the DTX handlers both on the transmit side and on the receive side and comprises a VAD on the transmit side as discussed above, a unit for evaluating the background noise on the transmit side in order to transmit characteristic parameters to the receive side and a unit for generating comfort noise on the receive side during periods when the radio transmission is cut. Through the VAD is determined whether a specific block of 20 ms from the speech coder comprises speech or not. Due to the changes both in noise level and in noise spectrum in mobile environments, the VAD generally has to be constantly adapted thereto. The VAD is an energy detector wherein the energy of a filtered signal is compared to a threshold and speech is indicated whenever the threshold is exceeded.

The insertion of comfort noise will now be briefly discussed. When a transmission is on, the background noise is transmitted together with the speech. As a speech period ends, the connection is off and the perceived noise will drop to a very low level. This would produce a step modulation of noise which would be perceived as annoying and it may also reduce the accuracy of speech if it were to be presented to a listener without any modification. This is called a noise contrast effect and this is reduced through the insertion of an artificial noise here referred to as comfort noise at the receiving end when speech is absent. The parameters which are needed for generation of the comfort noise are sent as background noise parameters before transmission is cut off and thereafter on scheduled positions. The frames comprising this background noise are the SID-frames as referred to above. This however does not relate to frames lost/corrupted during transmission.

Speech frames may be lost or bad for various reasons. For example in the receiver frames may be lost due to transmission errors or frame stealing for the fast associated control channel FACCH. Frames may also be lost during handover. To reduce the consequences of one single lost frame, a scheme may be used according to which the lost speech frame is substituted by a predicted frame based on the previous frame. For several consecutive lost frames however muting has to be done. Advantageous ways of doing this will now be more thoroughly described.

In the embodiment illustrated in FIGS. 1 and 2 relating to a full-rate transcoding case, the output from the speech-coder can be a block of 260 bits every 20 ms which gives a bit rate of 13 kbit/s. A known coding scheme can be used e.g. as described in the GSM Recommendations 06.10. The encoded speech at the output of the speech encoder is delivered to the channel coding functions in order to produce an encoded block. As to the receiving part as illustrated in FIG. 2, the corresponding inverse operations take place.

Now muting towards background noise will be more thoroughly described in relation to the muting algorithm.

Figure 3:
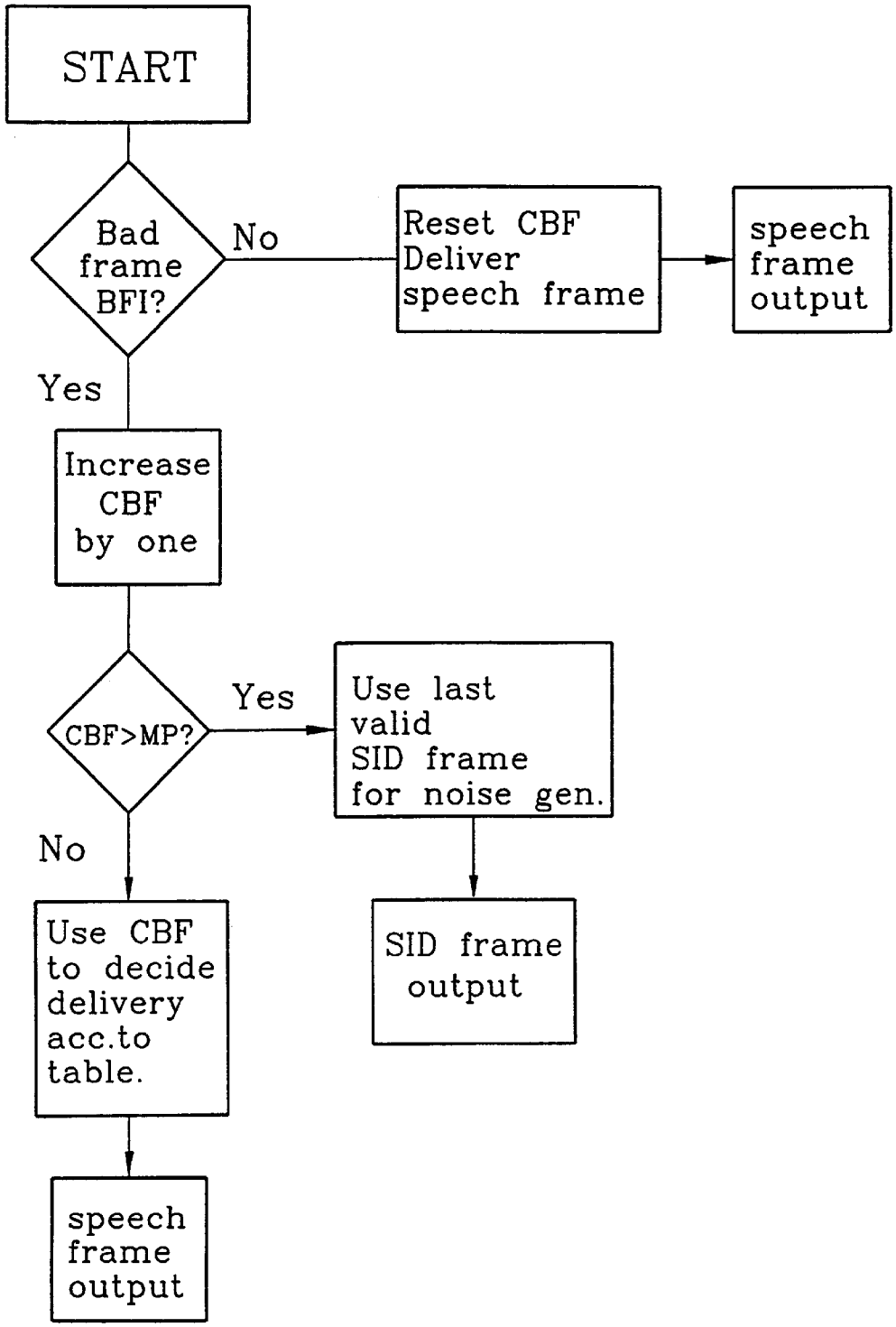
FIG. 3 illustrates a flow diagram of the muting according to the invention.

FIG. 3 shows a flow diagram of the muting algorithm, and the choice of output device of the speech samples. A variable "Counter of Bad Frames" (CBF) is introduced. "Mute Period" MP is a constant which is connected to the length of the mute table shown in FIG. 4.

When a frame is received the BFI indicates whether it is a bad frame or not. If it is settled that it is not a bad frame, the number of bad frames which have been received as indicated by the CBF number is reset to C) and the correctly received speech frame is delivered as output data and hence a speech frame is output. On the other hand, if BFI indicates that the frame is bad, the variable indicating the number of consecutive bad frames that have been received, CBF, is increased by 1. Then it is examined if the number of consecutive bad frames received, CBF, exceeds the length of the mute period in frames, MP. The length of the mute period MP is a given constant giving the number of frames during which muting is to be effected. If thus the number of consecutive bad frames received, CBF, exceeds the length of the mute period, MP, the preceding correctly received SID frame is used for generation of comfort-noise. Thereupon a SID frame is delivered as output data. (The mute period MP is e.g. taken to 4.) If on the other hand the number of consecutively received bad frames, CBF, is between 1 and MP, a muting algorithm is used to calculate a number of parameters to be used by the speech decoder. The parameters used by the speech decoder are for GSM defined in GSM 06.10, 06.11 and 06.12. In the exemplifying embodiment the parameters GAIN[N] and XMAX[N] are given by the muting algorithm described in FIGS. 3 and 4. CBF=(1=4) is a description of how to combine the parameters from the different frames available. CBF>=5 shows how plain SID frames are sent to the Comfort Noise Generator.

The transition from comfort noise to non-muted speech within one frame when a good frame is received, as described in FIG. 3, is relevant in disturbance conditions as occasional fadings or interferences.

However, under very bad conditions for radio transmission a problem occurs with receiving occasional frames that are not bad in periods where receiving BFI-marked frames is dominant. The change from comfort noise to the full volume speech frame and the muting to comfort noise again could create an disturbing transient on both the level and the spectrum.

Figure 7:
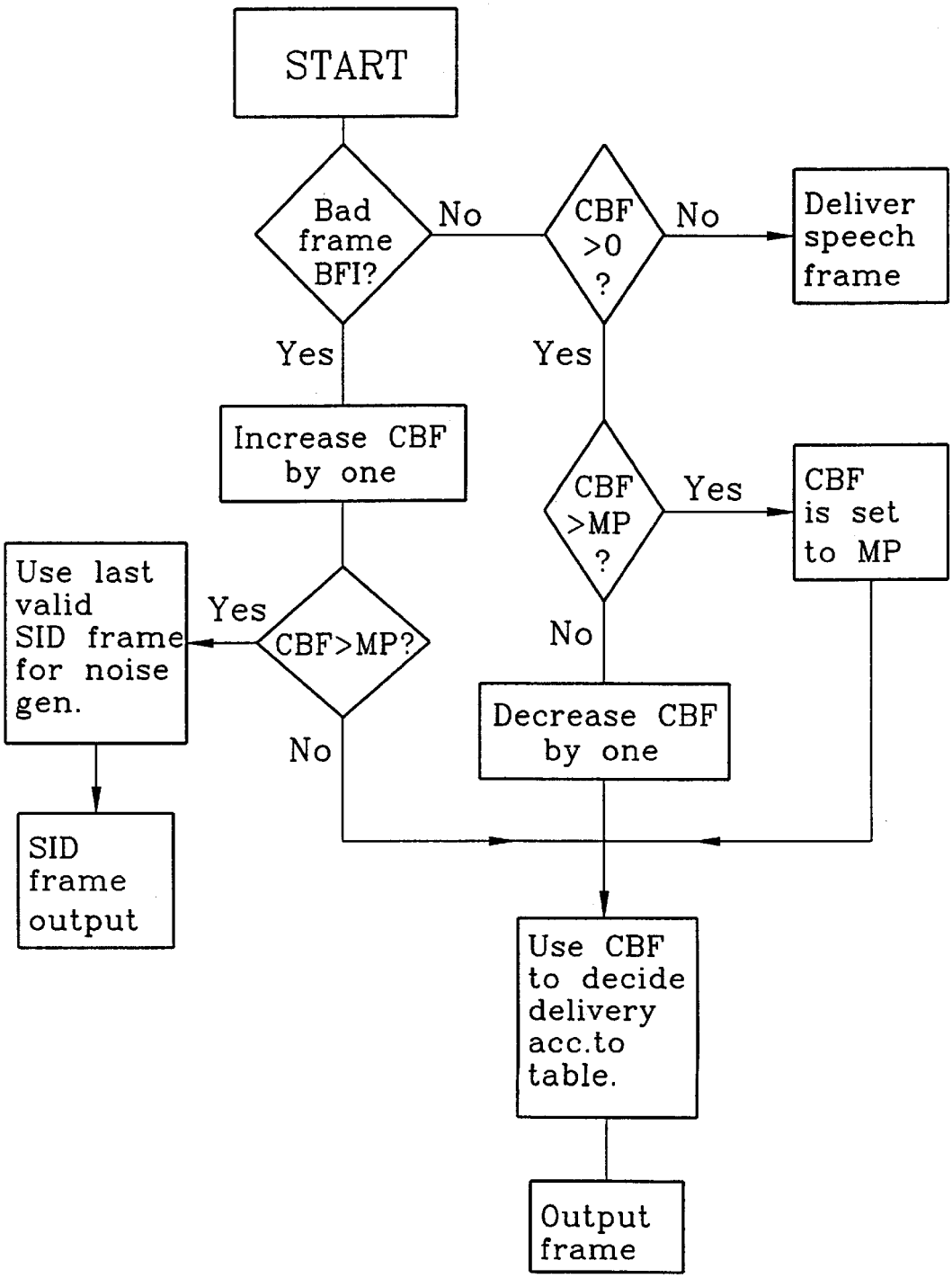
FIG. 7 shows a flow diagram as in FIG. 3 relating to an alternative embodiment comprising ramping up and FIG. 8 shows on alternative embodiment also comprising ramping up.

In an advantageous embodiment this is dealt with as schematically illustrated in the flow diagram of FIG. 7.

When a frame is received the BFI indicates whether it is a bad frame or not. If the frame is considered as bad the same muting procedure as described above is applied. On the contrary, if BFI indicates that the frame is not bad, a check is done to see if the previous frame was speech decoded without manipulation or not, i.e. if CBF is zero or not. If CBF is equal to zero the frame is delivered to the speech decoder without any manipulation. On the other hand, if CBF is greater than zero it is examined if in the comfort noise generation state or in the muting period, i.e. if CBF >MP. If in the comfort noise state the CBF is set to MP. On the other hand, if in the muting period the CBF is decreased by one. Then the same table as disclosed in FIG. 4 may be re-used for the ramping up of the speech. Finally the combined speech and comfort noise parameters are passed to the speech decoder.

In still another embodiment the counter CBF may be limited to values up to and including MP+1.

Figure 8:
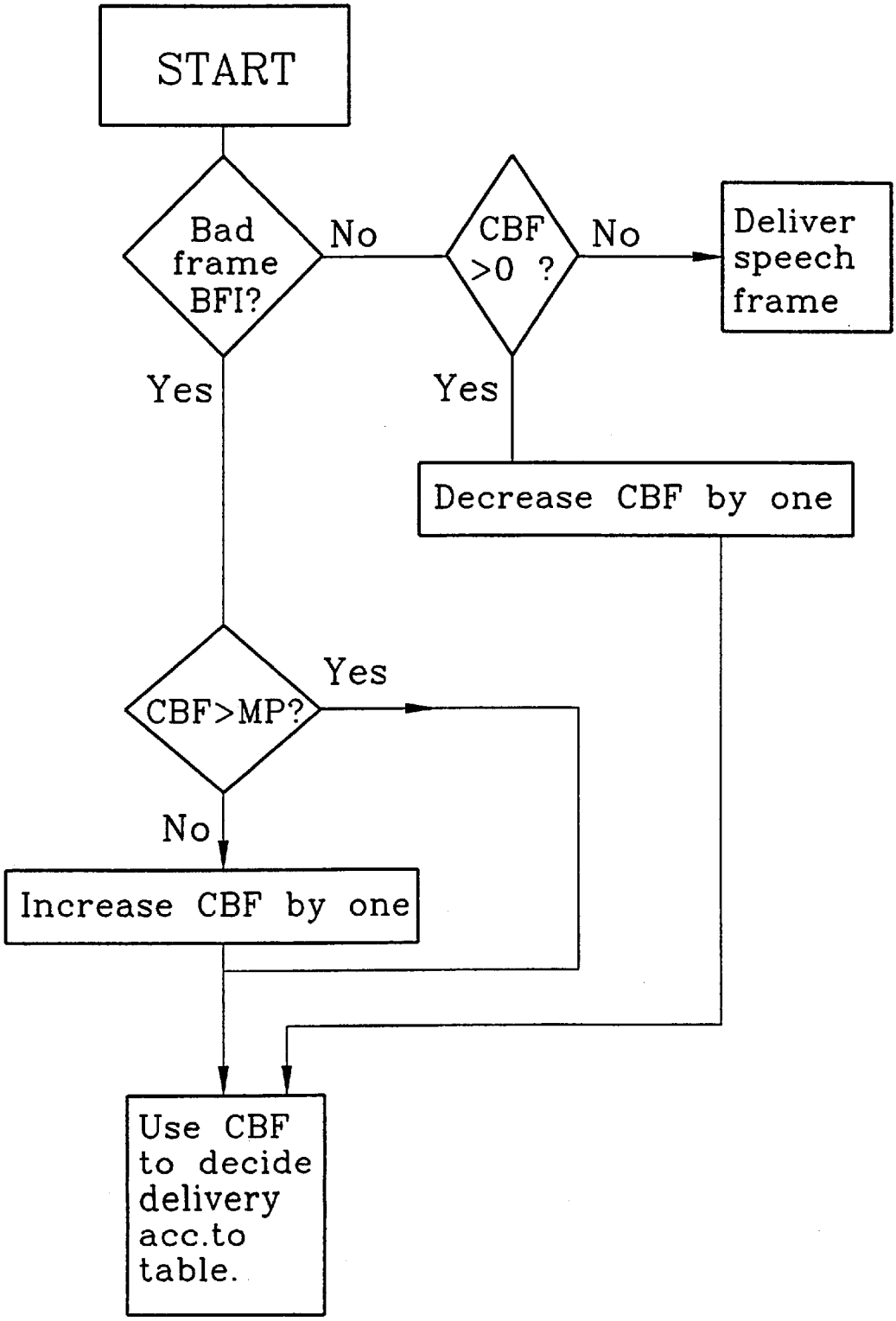

Ramping between speech frames and noise frames can then be done as illustrated in FIG. 8. As an example the table of FIG. 4 may be used to calculate the output frames.

The GSM full rate speech coding scheme at 13 kbit/s is called RPE-LTP (Regular Pulse Excitation-Long Term Prediction).

The speech coder first cuts the speech, represented by 13 bit linear PCM samples sampled at a rate of 8 kHz, into 20 ms slices, called frames. Such a frame of 160 samples is then pre-processed to produce an offset-free signal, which is then subjected to a first order pre-emphasis filter. The resulting 160 samples are then analyzed to determine the coefficients for the short term analysis filter, which is used for modelling the overall spectral envelope. This is done by using LPC, Linear Prediction Coding, analysis, i.e. to minimise the energy of the signal obtained when filtering the 160 samples through the reverse LPC filter. These parameters are then used for the filtering of the same 160 samples. The result is 160 samples of the short term residual signal. The filter parameters, termed reflection coefficients, are transformed to log area ratios, LARs, before transmission.

The short term residual signal is then divided into four sub-frames of 40 samples each.

Before the processing of each sub-block, the estimates of the parameters of the long term analysis filter are updated, based on stored reconstructed short term residual from the three last sub-frames together with current one. The long term analysis filter is determined to describe the similarity of successive periods of voiced segments. The parameters are denoted LTP lag and LTP gain, LTP denotes long term prediction. LTP lag gives an index of the periodicity and the LTP gain gives a value of the correlation energy, i.e. the similarity of the sub-blocks.

The LTP filter gives a prediction of the 40 short term residual samples of the sub-frame. Subtracted from the 40 short term residual samples, a block of 40 long term residual samples, for the sub-frame, is obtained. This is then repeated for all sub-frames.

These long term residual samples are then further compressed by RPE, regular pulse excitation, analysis. The result is a set of RPE-parameters, of which the Xmax parameter gives the estimated sub-block amplitude.

This just relates to one particular embodiment and of course the table can take many other forms; i.e. the output frame does not have to vary according to the pattern given here but according to any other pattern and the mute period does not have to be 4 but can also take other values.

In an advantageous embodiment, one or more frames representing background noise can be stored in the system, either permanently or temporarily. Irrespectively of whether it is stored in a mobile station or a base station or any other part of the system it can be stored therein upon the fabrication thereof or when it is programmed. It might also be stored temporarily for a call or for any desired period.

An operator of a network has the possibility to configure the network in such a way as to not use the discontinuous transmission DTX function. It is also possible for the network operator to leave the choice to the individual users who then can choose whether or not they want to use the DTX function.

However, when the DTX function is used, SID frames will arrive with a given regularity describing the background noise during periods of no speech. If a SID frame is valid it should be saved. The SID frame generator and the comfort noise generator which are arranged in the system to provide DTX functionality are used to provide access to appropriate background noise on the receiving side.

Figure 5:
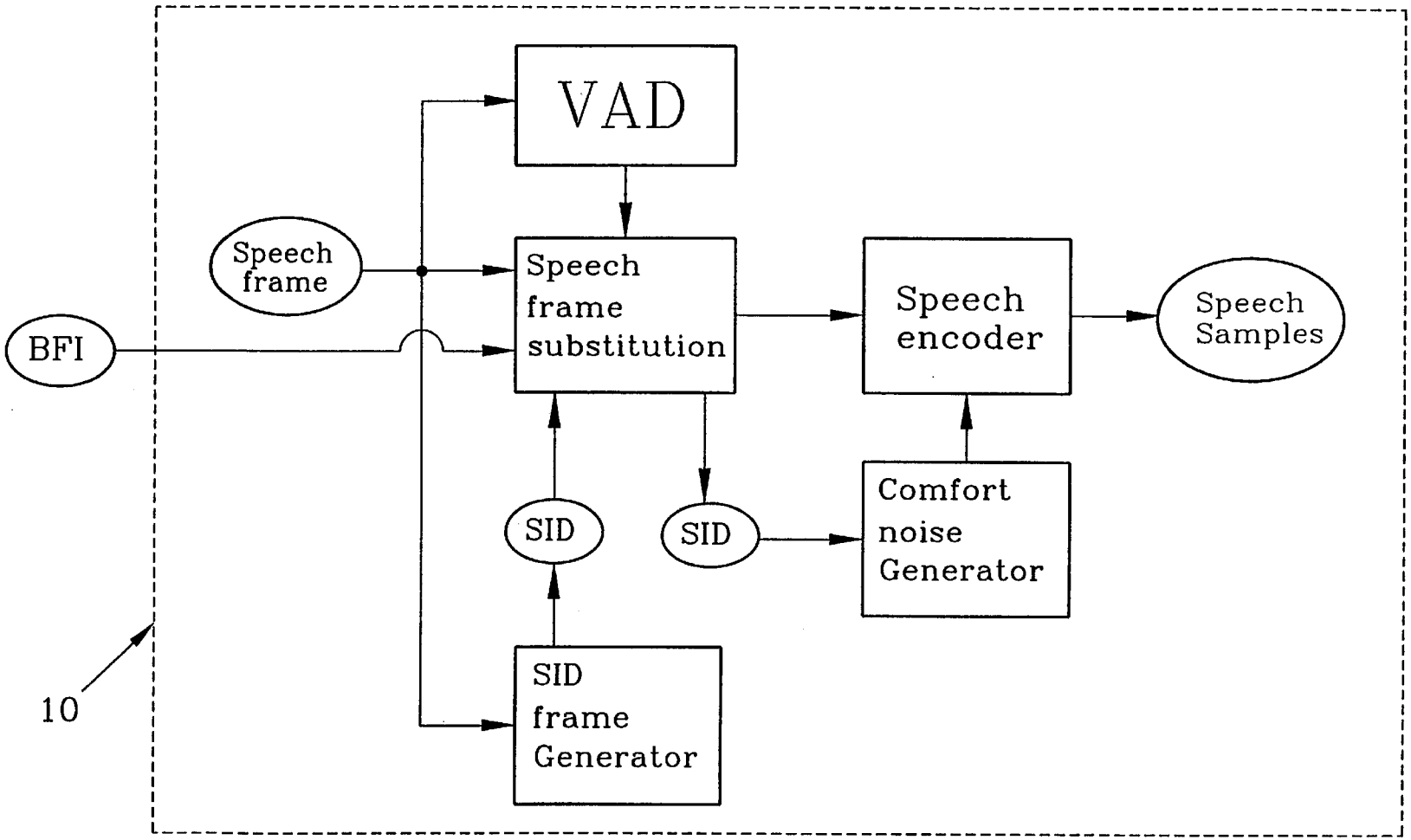
FIG. 5 shows a further embodiment of the invention in which SID-frames are assumed not to be transmitted and FIG. 6 illustrates application of the invention on an analog system

FIG. 5 relates to the receiving side of a further embodiment with no DTX functionality. The received info bits will then always be speech frames. A SID frame generator is introduced, which generates SID frames based on the received speech frames. A VAD is also implemented. In case of no voice activity for a certain number of frames the SID frame from the SID Frame Generator will be stored in the Speech Frame Substitution unit for possible further use. In case of reception of a BFI-marked frame, speech frame substitution will be done according to the algorithms described in FIGS. 3 and 4. Of course ramping up as described in FIGS. 7 and 8 can also be applied here.

According to a further embodiment of the invention wherein reference can be made to FIGS. 1 and 2, a system not using DTX can force SID frames in periods of no speech. The SID frames can be used on the receiving side by the Speech Frame Substitution Unit. According to one particular embodiment these SID frames can be sent e.g. once a second if VAD indicates no speech for a given number of frames. They can be calculated in a number of different ways.

This modification will not induce any noticeable change for the user when the channel conditions are good. Furthermore the "forced" SID-frames are just stuffed in between speech frames in periods when no speech activity is detected.

The receiving side saves the last accepted (not BFI-marked) SID frame for use when needed. In case of reception of a BFI-marked frame, speech frame substitution will be done according to the algorithms described in FIGS. 3 and 4. Also here ramping up can be provided as described earlier.

Figure 6:
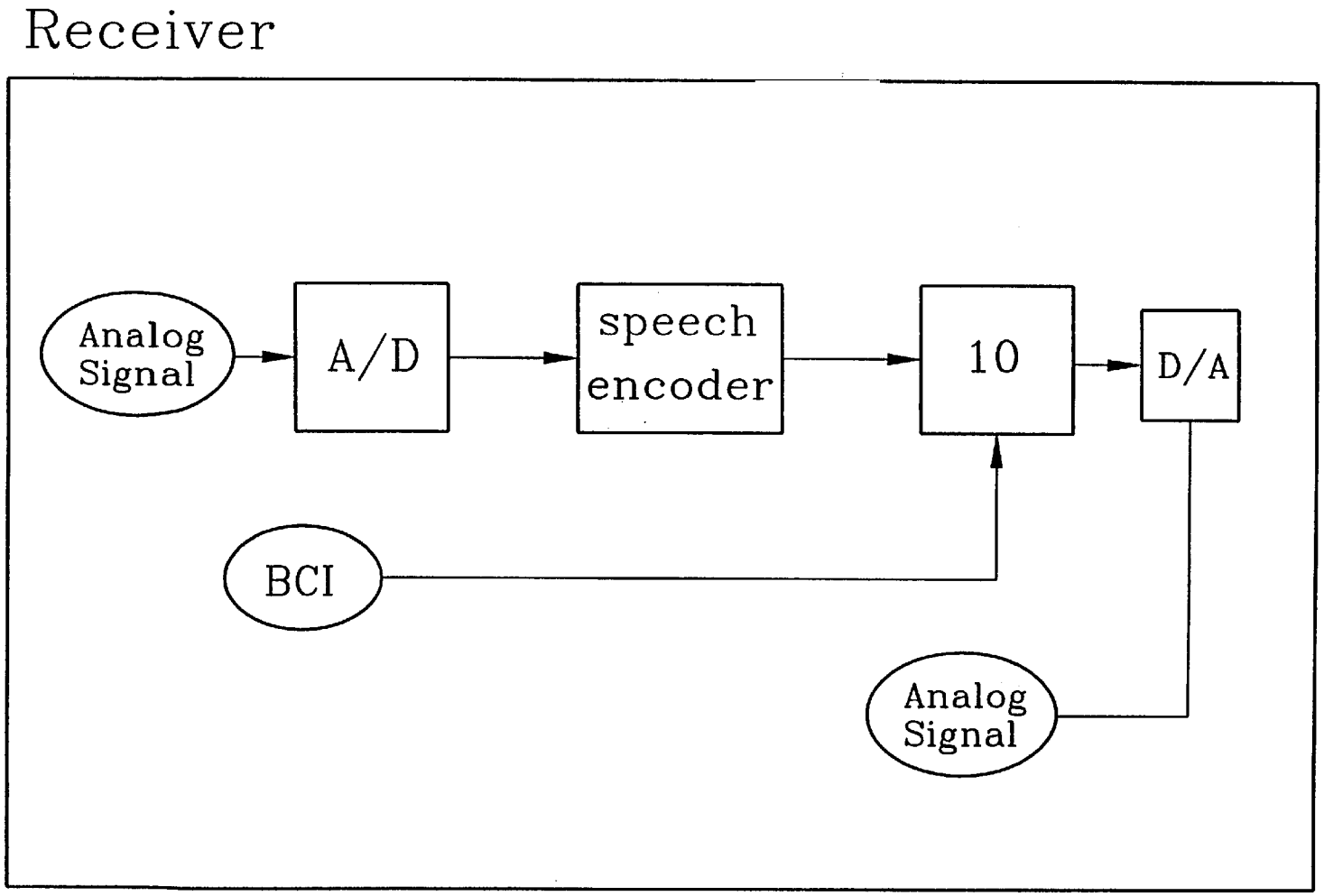

FIG. 6 illustrates a further embodiment showing how the inventive concept of the present invention can be applied in an analog system. The analog speech signal is first sampled in an A/D-device, and then after the bad speech concealement measure returned to analog. This whole unit can be implemented on the receiving side. In this case no BFI is available. Necessary for operation is thus a "Bad Channel Indication" (BCI) signal which indicates (to an arrangement 10 which can be of the kind as illustrated in FIG. 5) in which periods the received analog signal is bad.

What is claimed is:

1. A speech transmission system in which signals are divided into a frame structure, the speech transmission system comprising:

means for detecting if a signal contains speech information;

means for detecting if a frame has been corrupted or lost during transmission and if so replacing the corrupted or lost frame by a suitable frame; and an arrangement comprising means for counting a number of frames and means for determining a number of received corrupted or lost frames, wherein if the number of received consecutive corrupted or lost frames exceeds a predetermined value, the received corrupted or lost frames are replaced by suitable frames, and wherein the suitable frames are combinations of background noise frames and speech frames generated in such a way as to gradually approach background noise.

2. The system of claim 1, wherein the predetermined value is a length for a mute period.

3. The system of claim 1, wherein the predetermined value is a number of corrupted or lost frames preceding a speech frame.

4. The system of claim 3, wherein if a number of correctly received speech frames follow after a number of received corrupted or lost frames, at least the first of the correctly received speech frames is replaced by a frame which is a combination of at least one correctly received speech frame and at least one frame representing background noise.

5. The system of claim 4, wherein output frames produced by the arrangement gradually approach pure speech frames.

6. The system of claim 1, wherein the speech transmission system uses discontinuous transmission.

7. The system of claim 1, further comprising means for generating frames representing background noise at a transmitting end during speech pauses and means for using the frames representing background noise at a receiving end for replacing received corrupted or lost frames.

8. The system of claim 1, further comprising means for generating frames representing background noise at a receiving end.

9. The system of claim 1, further comprising means for storing at least one frame representing background noise in the system.

10. In a speech transmission system in which signals are divided into a frame structure, an arrangement comprising means for detecting if a signal contains speech information; means for detecting if frames are bad or not; and means for counting a number of frames and determining a number of corrupted or lost frames, wherein if a speech frame is correctly received, it is determined whether a given number of frames directly preceding the correctly received speech frame are bad, and if so, the correctly received speech frame is replaced by a frame representing a combination of background noise and a correctly received speech frame.

11. The arrangement of claim 10, wherein if a given number of consecutive correctly received frames are preceded by a given number of bad frames, the correctly received frames are replaced by frames which are combinations of speech frames and background noise frames so as to gradually approach speech.

12. A telecommunications system, comprising:

a number of receiving arrangements and a number of transmitting arrangements, wherein audio signals divided into frames of encoded data are transmitted between the transmitting and receiving arrangements;

means for encoding the audio signals and means for decoding encoded data;

audio detecting means for detecting if speech activity is present in transmitted signals;

means for indicating bad frames;

a noise generator;

a counter for counting a number of frames; and means for determining a number of corrupted or lost frames;

wherein if the bad frame indicating means indicates that a speech frame is lost or corrupted during transmission, the lost or corrupted frame is replaced by a frame representing mainly background noise or a combination of at least one such frame and at least one correctly received speech frame.

13. The telecommunications system of claim 12, wherein if at least two consecutive frames are corrupted or lost during transmission, those frames are replaced by frames which are combinations of background noise frames and speech frames in such a way as to gradually approach background noise.

14. A method for improving speech quality in a speech transmission system in which speech signals are divided into a frame structure, the method comprising the steps of:

detecting if a speech frame has been lost or corrupted during transmission;

replacing a lost or corrupted frame by a frame representing mainly background noise or at least one frame representing mainly background noise in combination with at least one correctly received speech frame; and if at least two consecutive frames are corrupted or lost during transmission, replacing those frames by frames which are combinations of background noise frames and speech frames in such a way as to gradually approach background noise.

15. A method of substituting frames in a speech transmission system in which signals are divided into a frame structure, the method comprising the steps of:

detecting if a signal contains a speech frame;

determining if the speech frame is bad and incrementing a bad frame counter;

comparing the value of the counter with a predetermined value; and if the counter value exceeds the predetermined value, substituting an output frame for the bad frame; and if the frame is not bad, checking to determine if the counter value is an initial value, and if the counter value is the initial value, delivering the frame to the speech decoder without manipulation.

16. The method of claim 15, wherein if the frame is a good frame, the counter is restored to an initial value.

17. The method of claim 15, wherein the output frame is a correctly received SID (Silence Descriptor) frame.

18. The method of claim 15, further comprising the steps of:

determining if the counter value is greater than the initial value;

examining if the system is in a comfort noise generation state or in a muting period;

if the system is in the comfort noise generation state, setting the counter value to a muting value, and if the system is in the muting period, decreasing the counter value;

ramping up the speech; and outputting combined speech and comfort noise parameters to a speech decoder in the system.

* * * * *